United States Patent [19]

Gaiffi et al.

[11] 4,174,303

[45] * Nov. 13, 1979

[54] CERAMIC ELECTRICAL MATERIAL WITH HIGH NONLINEAR RESISTANCE

[75] Inventors: Severino Gaiffi; Hans-Peter Klein, both of Nussbaumen, Switzerland

[73] Assignee: BBC Brown Boveri & Company Limited, Baden, Switzerland

[ * ] Notice: The portion of the term of this patent subsequent to Nov. 28, 1995, has been disclaimed.

[21] Appl. No.: 811,867

[22] Filed: Jun. 30, 1977

[30] Foreign Application Priority Data

Jul. 1, 1976 [CH] Switzerland ..... 8425/76

[51] Int. Cl.[2] ..... H01B 1/08

[52] U.S. Cl. ..... 252/518; 252/519

[58] Field of Search ..... 252/519, 518; 106/73.5

[56] References Cited

U.S. PATENT DOCUMENTS

| | | | |
|---|---|---|---|
| 3,764,566 | 10/1973 | Matsuoka et al. | 252/518 |
| 3,926,858 | 12/1975 | Ichinose et al. | 252/519 X |
| 3,962,144 | 6/1976 | Matsuura et al. | 252/519 |
| 4,046,847 | 9/1977 | Kresge | 252/518 X |

*Primary Examiner*—Benjamin R. Padgett
*Assistant Examiner*—E. Suzanne Parr
*Attorney, Agent, or Firm*—Oblon, Fisher, Spivak, McClelland & Maier

[57] ABSTRACT

A ceramic electrical material with high nonlinear resistance has a base of zinc oxide and at least one other component. A method is provided for producing such a material.

14 Claims, 2 Drawing Figures

CERAMIC ELECTRICAL MATERIAL WITH HIGH NONLINEAR RESISTANCE

BACKGROUND OF THE INVENTION

1. Field of the Invention

The invention relates to a ceramic electrical material with high nonlinear resistance having a base of zinc oxide and at least one other component.

The invention further is concerned with a method for producing such ceramic electrical material.

2. Description of the Prior Art

Electrical resistor materials with nonlinear current-voltage characteristics in the form of sintered ceramic masses are known in numerous compositional varieties. A main group of these materials has a zinc oxide base, to which other metal oxides are added for the formation of insulating grain boundary intermediate layers. The current-voltage characteristic of such nonlinear resistors in the range of interest is ordinarily described by the following equation:

$$I = \left(\frac{U}{C \cdot d}\right)^{\alpha}$$

I = current in mA flowing through a 1 $cm^2$ cross section

U = voltage in V across the resistor

C = "nonlinear resistance" measured in V/mm in the direction of potential drop for a current of 1 $mA/cm^2$ d = thickness in mm of the resistor in the direction of potential drop $\alpha$ = nonlinear (voltage −) exponent.

Customarily, $\alpha$ is defined for one or more current ranges of interest, e.g.:

$\alpha_1$ for 0.1 to 1 $mA/cm^2$ $\alpha_2$ for 1 to 10 $mA/cm^2$.

By choice of the composition of the additives enveloping the zinc oxide base, the characteristic parameters C and $\alpha$ can be varied within wide limits and matched to the particular application of the resistor. In order to obtain a sufficiently large $\alpha$ it was thought necessary in the prior art that the mixtures contain at least one of the two oxides PbO and $Bi_2O_3$ and still other additives for their stabilization. Such resistor materials and method of producing them are described in numerous publications (e.g. Michio Matsuoka, "Nonohmic Properties of Zinc Oxide Ceramics," *Jap. Jour. Applied Physics*, Vol. 10, No. 6 (June 1971); DT-OS 24 50 108; DT-AS 23 10 437; DT-OS 23 69 232).

Practically all ceramic electrical materials with a nonlinear characteristic based on zinc oxide are distinguished by a small voltage drop for given dimensions and current. For a current density of 1 $mA/cm^2$ the field strength is 300 V/mm at most. Efforts are directed mainly at keeping this value as low as possible in order to be able to make satisfactorily small resistors for very low voltages (see e.g. DT-OS 24 50 108; DT-OS 24 45 627). In applications using resistors with such characteristics as overvoltage limiters for high voltage use, the dimensions become unacceptably large.

Most zinc oxide base nonlinear resistors have bismuth oxide as the essential additive. This is connected with the favorable effect of this component, so that there is a widespread expert prejudice to the effect that no resistor with a high nonlinear exponent $\alpha$ can be produced without $Bi_2O_3$.

In practice, however, adherence to a fixed composition of the material leads to serious difficulties and the analysis of the end product can differ greatly from that of the initial mixture. This is connected with the great volatility of $Bi_2O_3$, which at the customary sintering temperature of over 1100° C. already has so high a vapor pressure that a significant portion of it evaporates during the sintering process, which leads to uncontrollable and hard-to-duplicate results in the final composition of the sintered material. The evaporation rate depends on the temperature, the time, the oven volume and the temperature gradient in the oven, and can be determined and maintained constant only with great difficulty.

Nonlinear resistor parts with a $ZnO + Bi_2O_3$ base and containing other additives exhibit an unsatisfactory electrical stability. Their current-voltage characteristic changes during electrical loading. Such loading can consist of, for example, a d.c. current load of 1 $mA/cm^2$ current density at 70° C. ambient temperature, acting for over 500 hr. Another possible harmful type of load is, for example, a succession of two current pulses of the first standard curve shape 8/20 (interval in $\mu$sec) of "IEC Publication 99-1, 1958/1970 Edition" or "VDE 0675, Guidelines for Overvoltage Protection Devices, Part 1: Valve-type Arresters for A.C. Lines of May 1972" with a maximum current density of 1000 $A/cm^2$. Such loads alter the characteristic unfavorably in that the nonlinear resistance (C) and the nonlinear exponent ($\alpha$) decrease, whereby the component involved has a reduced functional capability. It is to be noted that the characteristic becomes current-direction dependent, i.e. asymmetric; and it is no longer identical in the forward and reverse directions. This makes the component unusable for many practical applications.

From the processing point of view the desire is for the greatest possible simplification and effective control of the production process. Because of the high volatility of the additives used heretofore, the end product is dependent in its properties to a high degree on hard-to-control production parameters, whereby in particular the reproducibility of the results suffers.

SUMMARY OF THE INVENTION

Accordingly, one object of the present invention is to provide ceramic electrical materials which have a high nonlinear resistance and a high nonlinear exponent.

Another object of the invention is to provide ceramic electrical materials with high stability and reproducible properties.

Yet another object of the invention is to provide a method of producing ceramic electrical materials, which method permits simplification and effective control of the production process, avoids the use of highly volatile ingredients, and leads to a stable product with reproducible properties.

Briefly, these and other objects of the present invention can be attained by providing ceramic electrical materials which have a composition comprising a base of zinc oxide and at least one oxide of silicon, and which contain essentially no bismuth oxide; and by providing a method for the production of such materials.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
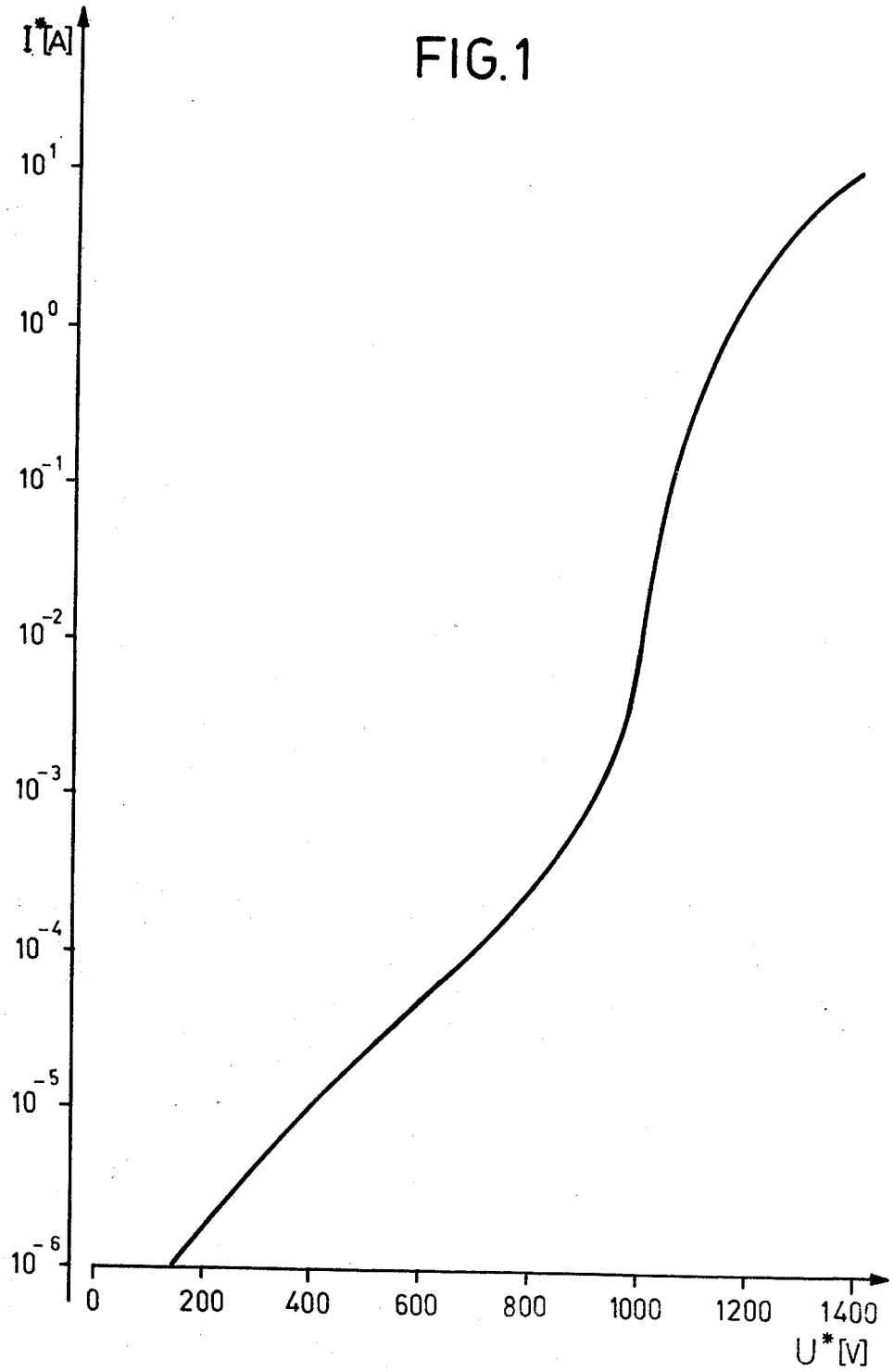
FIG. 1 is the current-voltage characteristic, $I^* = f(U^*)$, for a sintered ceramic material having the composition of Example 1.

The ceramic electrical materials of the invention have a composition comprising a base of zinc oxide, and at least one oxide of silicon, and may also contain at least one additional oxide selected from the group consisting of the oxides of cobalt, manganese, chromium, antimony, nickel, and mixtures thereof. No bismuth oxide is used in preparing the composition.

The zinc oxide base is present in an amount of from 50 to 99.9 mol. %, and preferably from 90 to 98 mol.%.

The preferred oxide of silicon is silicon dioxide, $SiO_2$, which is advantageously present in an amount of from 0.05 to 10 mol.%, and preferably from 0.5 to 3 mol.%.

Suitable additional oxides may be added such as CoO, $MnO_2$, $Sb_2O_3$, $Cr_2O_3$, and NiO. These additional oxides are advantageously present in an amount of from 0.01 to 5 mol.%, and preferably from 0.01 to 3 mol.%.

It is preferred to utilize admixtures of these additional oxides. In particular, admixtures which comprise 0.2 to 2.0 mole percent of NiO, 0.2 to 2.0 mole percent $MnO_2$, 0.5 to 3.0 mole percent $Sb_2O_3$ and 0.01 to 1.0 mole percent $Cr_2O_3$. Another preferred admixture comprises 0.2 to 2.0 mole percent of CoO, 0.2 to 2.0 mole percent $MnO_2$, 0.5 to 3.0 mole percent $Sb_2O_3$ and 0.01 to 1.0 mole percent $Cr_2O_3$.

In accordance with the invention, the ceramic electrical materials are produced by mixing, drying, sifting, calcining and pressing the powdered raw materials of 0.1 to 1 $\mu$ grain size and subjecting the resultant briquette to a heat treatment.

In a typical process, the appropriate metal oxides are mixed with a suitable vehicle, such as ethanol, and the paste is ground in a ball mill to produce a powder with an average grain diameter of from about 0.1$\mu$ to 1$\mu$.

The powder is evaporatively dried and sifted through a sieve, preferably of about 0.5 mm mesh size.

The sifted powder is then calcined or annealed in air, preferably at about 450° C., for a period of time of from 1 to 3 hours, preferably about 3 hours.

The calcined powder is made into tablets in a tablet press, preferably using about a one-gram portion for each tablet, and preferably producing tablets of about 13 mm diameter. The pressing is carried out at pressures of from 300 to 500 kp/cm$^2$, preferably 500 kp/cm$^2$.

The tablets are sintered to produce a sintered briquette. Sintering is advantageously performed at a temperature of from 1100° to 1350° C. in air for about 1 hour, and preferably at from 1200° to 1250° C.

For some compositions, the $\alpha$ exponent can be further raised if the sintered briquette is subjected to a further annealing treatment, which advantageously comprises annealing the sintered briquette for about 15 hours at a temperature of from 600° to 1000° C. under a pressure of about 760 torr., in an oxygen atmosphere. A preferred temperature range for this annealing is from 800° to 850° C.

After heat treatment, the briquette is ground plane parallel on its two faces and provided with contacts. Suitable methods for applying contacts include baking, vapor deposition, sputtering, or metal spraying.

The ceramic electrical materials of the invention show high nonlinear resistance and permit much higher field strengths than known materials. They may be used for the production of overvoltage arresters for medium and high voltages with convenient space-saving dimensions. The materials exhibit high electrical stability and only slight asymmetry of the current-voltage characteristic in the forward and reverse directions after being current-loaded. The materials of the invention are distinguished by great constancy of their chemical composition and consequently uniform characteristic properties.

By the production method of the invention highly volatile components in the sinter-masses are avoided, so that the composition of the end product can easily be adjusted by weighing the starting materials and is independent of the sintering conditions. Thus, closely reproducible properties are achievable in different batches of the same resistor type, which is of decisive importance for practical use as an electrical circuit component.

Having generally described the invention, a more complete understanding can be obtained by reference to certain specific examples, which are included for purposes of illustration only and are not intended to be limiting unless otherwise specified.

EXAMPLE 1

In an agate beaker of 250 ml capacity 20 g of a powder of the composition

| | |
|---|---|
| ZnO | 96.95 mol - % |
| $SiO_2$ | 1 mol - % |
| NiO | 0.5 mol - % |
| $MnO_2$ | 0.5 mol - % |
| $Sb_2O_3$ | 1 mol - % |
| $Cr_2O_3$ | 0.05 mol - % |

were mixed with 150 ml of technical grade ethyl alcohol. The paste was ground with 5 agate balls of 10 mm diameter for 1 hr. in a ball mill (Pulverisetta type laboratory crusher). The average grain diameter in the resulting material ranges from 0.1 $\mu$ to 1 $\mu$. Next the powder was dried by evaporation of the ethyl alcohol. Then the powder was sifted through a sieve of 0.5 mm mesh size and calcined for 3 hr. at 450° C. in air. Each 1 g of powder was made into a 13 mm diameter tablet in a simple laboratory press at a pressure of 500 kp/cm$^2$. The briquettes were placed on a platinum foil, covered with an alumina crucible of 40 mm diameter and 40 mm height and put into a cold oven. The oven was then heated rapidly to the sintering temperature of 1250° C. and turned off after a sintering duration of 1 hr. at 1250° C. The samples were left in the oven so that they cooled at an average rate of 300° C./hr. to a temperature of 300° C. The entire sintering process was carried out in air.

A tablet sintered in this manner presents a diameter of 10 mm and a thickness of 2.5 mm. The tablet was ground plane parallel on its two sides with abrasive paper of coarseness 400. Cross-shaped silver foil contacts were applied to the two sides, their outside edges approaching no closer than 1 mm to the rim of the tablet.

Electrical testing with a d.c. voltage gave the following values of the nonlinearity:

$$\alpha_1 = \alpha_{0.1 \div 1\ mA/cm^2} = 8$$

$$\alpha_2 = \alpha_{1 \div 10\ mA/cm^2} = 25$$

$$C = 560\ V/mm$$

The current-voltage characteristic is shown in FIG. 1. The voltage scale is linear while the current scale is logarithmic.

EXAMPLE 2

Following the procedure given in Example 1, 20 g of a powder with the composition

| | |
|---|---|
| ZnO | 96.95 mol - % |
| $SiO_2$ | 1 mol - % |
| CoO | 0.5 mol - % |
| $MnO_2$ | 0.5 mol - % |
| $Sb_2O_3$ | 1 mol - % |
| $Cr_2O_3$ | 0.05 mol - % |

were mixed with ethyl alcohol, dried, pressed and sintered. A very good $\alpha$ as well as a high C was obtained with this material. The electrical measurements on finished sintered samples gave the following values:

$$\alpha_1 = \alpha_{0.1 \div 1\ mA/cm^2} = 44$$

$$\alpha_2 = \alpha_{1 \div 10\ mA/cm^2} = 37$$

$$C = 980\ V/mm.$$

Figure 2:
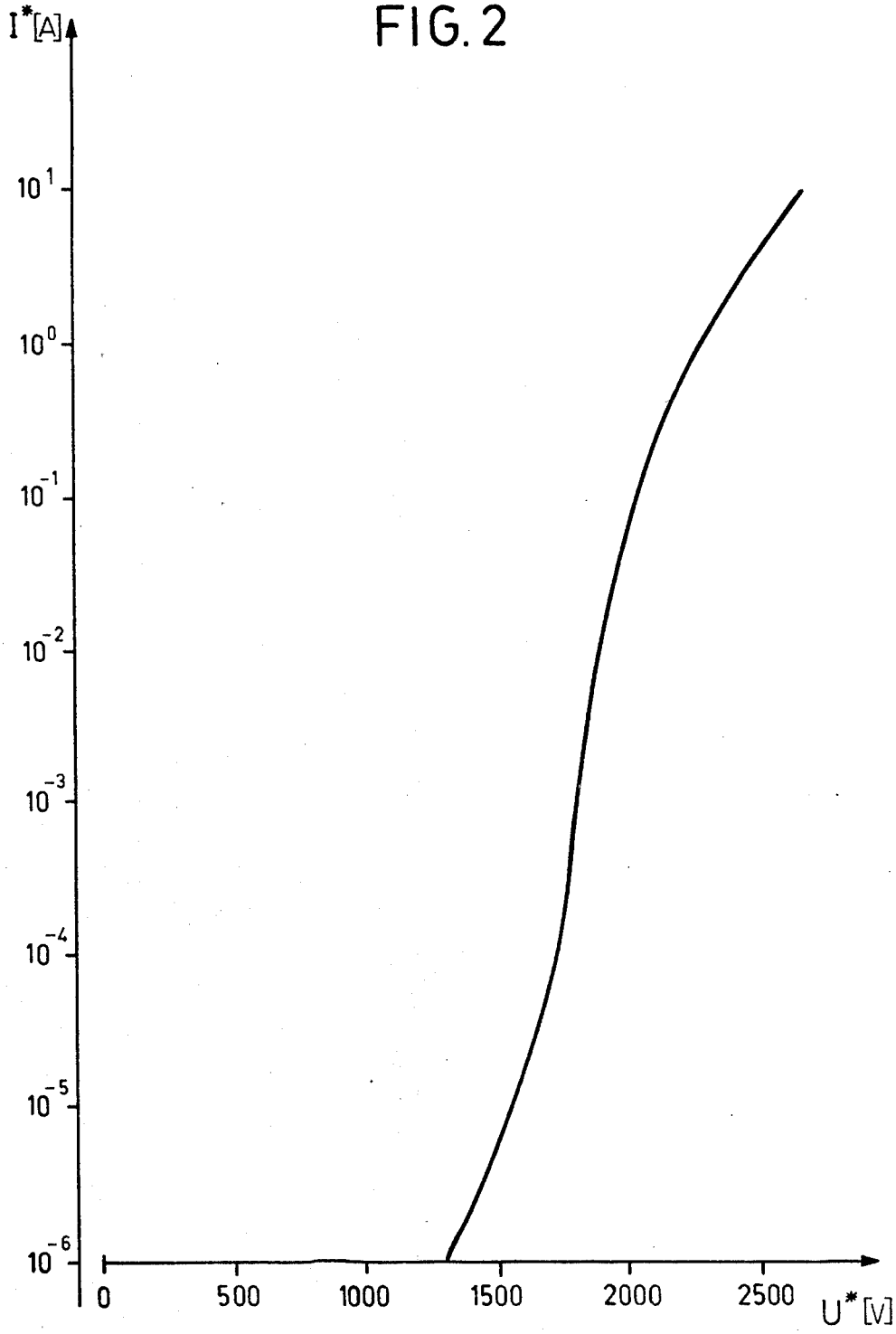
FIG. 2 is the current voltage characteristic, $I^* = f(U^*)$ for a sintered ceramic material having the composition of Example 2.

The current-voltage characteristic is shown in FIG. 2. The voltage scale is linear while the current one is logarithmic.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method of producing a ceramic electrical material having a high non-linear resistance, which consists essentially of 50–99.9 mol % of zinc oxide, 0.5 to 3 mol % of at least one oxide of silicon; wherein said ceramic material contains essentially no bismuth oxide; which comprises the steps of: mixing the starting materials in powder form and with grain size of from 0.1 to 1μ; drying; sifting; calcining at about 450° C. for from 1 to 3 hours; pressing; and subjecting the resulting briquette to a heat treatment.

2. The method of claim 1, wherein said oxide of silicon is silicon dioxide, $SiO_2$.

3. The method of claim 1, wherein said pressing is carried out at a pressure of from 300 to 500 kp/cm$^2$.

4. The method of claim 1 wherein said heat treatment comprises sintering at from 1100° to 1350° C. for about one hour in air to produce a sintered briquette and further annealing said sintered briquette for 15 hours at a temperature of from 600° to 1000° C. under a pressure of 760 Torr, in an oxygen atmosphere.

5. The method of claim 4, wherein said sintering temperature is from 1200° to 1250° C.

6. The method of claim 4, wherein said sintered briquette is provided with metal contacts on its flat faces.

7. The method of claim 6, wherein said contacts are produced by baking, vapor deposition, sputtering, or metal spraying.

8. The method of claim 4, wherein said temperature is from 800° to 850° C.

9. The electric ceramic material produced by the process of claim 1.

10. The process of claim 1 wherein the starting materials contain from 0.01 to 5 mol % of at least one additional oxide selected from the group consisting of oxides of antimony, chromium manganese and nickel.

11. The method of claim 10, wherein said additional oxide is present in an amount of from 0.01 to 3 mol %.

12. The process of claim 1, wherein the starting materials contain from 0.01 to 5 mol % of at least one additional oxide selected from the group consisting of oxides of antimony, chromium manganese and cobalt.

13. The electric ceramic material produced by the process of claim 10, wherein said material exhibits a current-voltage characteristic described by the relationship:

$$I = \left(\frac{U}{C \cdot d}\right)^{\alpha}$$

where,

I = current in mA flowing through a 1 cm$^2$ cross section of said material;

U = voltage in V across the material;

C = "nonlinear resistance" measured in V/mm in the direction of potential drop for a current of 1 mA/cm$^2$;

d = thickness in mm of the material in the direction of potential drop;

$\alpha$ = nonlinear (voltage −) exponent;

wherein, $\alpha$ in the current range from 0.1 to 1 mA/cm$^2$ equals at least 8;

$\alpha$ in the current range from 1 to 10 mA/cm$^2$ equals at least 25; and

C equals approximately 560 V/mm.

14. The electric ceramic material produced by the process of claim 12, wherein said material exhibits a current-voltage characteristic described by the relationship:

$$I = \left(\frac{U}{C \cdot d}\right)^{\alpha}$$

where,

I = current in mA flowing through a 1 cm$^2$ cross section of said material;

U = voltage in V across the material;

C = "nonlinear resistance" measured in V/mm in the direction of potential drop for a current of 1 mA/cm$^2$;

d = thickness in mm of the material in the direction of potential drop;

$\alpha$ = nonlinear (voltage −) exponent, wherein, $\alpha$ in the current range from 0.1 to 1 mA/cm$^2$ equals at least 44;

$\alpha$ in the current range from 1 to 10 mA/cm$^2$ equals at least 37; and

C equals approximately 980 V/mm.

* * * * *